United States Patent [19]

Harrison

[11] Patent Number: 4,747,692

[45] Date of Patent: May 31, 1988

[54] BEVERAGE DISPENSER

[76] Inventor: Roger D. Harrison, 55 W. Gainsborough Rd., Thousand Oaks, Calif. 91360

[21] Appl. No.: 913,526

[22] Filed: Sep. 30, 1986

Related U.S. Application Data

[63] Continuation-in-part of Ser. No. 698,027, Feb. 4, 1986, abandoned.

[51] Int. Cl.[4] ..... B01F 15/02

[52] U.S. Cl. ..... 366/164; 222/129.1; 366/102

[58] Field of Search ..... 366/150, 160, 162, 165, 366/167, 168, 172, 173, 164, 143, 101, 102, 106, 107, 336, 337–340, 341, 348, 349; 222/129.1; 99/323.1, 275

[56] References Cited

U.S. PATENT DOCUMENTS

| | | | |
|---|---|---|---|
| 2,894,732 | 7/1959 | Taber | 366/143 |
| 3,709,408 | 1/1973 | Syverson . | |
| 3,759,422 | 9/1973 | Matheney . | |
| 3,800,826 | 4/1974 | McCann | 222/129.1 |
| 3,830,407 | 8/1974 | Wierlo . | |
| 3,941,355 | 3/1976 | Simpson | 366/336 |
| 4,266,726 | 5/1981 | Brown | 222/129.1 |
| 4,310,493 | 1/1982 | Pisaric | 366/336 |
| 4,357,861 | 11/1982 | Di Girolamo . | |
| 4,364,666 | 12/1982 | Keyes . | |
| 4,390,284 | 6/1983 | Hyde | 366/165 |
| 4,498,819 | 2/1985 | Saie | 366/165 |
| 4,499,561 | 2/1985 | Mason | 366/165 |

FOREIGN PATENT DOCUMENTS

| | | | |
|---|---|---|---|
| 1369218 | 10/1974 | United Kingdom | 366/165 |

*Primary Examiner*—Robert W. Jenkins

*Attorney, Agent, or Firm*—Christie, Parker & Hale

[57] ABSTRACT

A single unit beverage dispenser which is to be connected to a source of pressurized water and one or more sources of pressurized syrups. Activation of the beverage dispenser will cause dispensing of a syrup in the right proportion with water into a mixing chamber or a conduit which is in communication with a whipping chamber. A whipping device is contained within the whipping chamber causing whipping of the combined water and syrup prior to being dispensed into a cup or glass located exteriorly of the beverage dispenser.

22 Claims, 5 Drawing Sheets

BEVERAGE DISPENSER

CROSS-REFERENCE TO RELATED APPLICATIONS

This is a continuation-in-part of application Ser. No. 698,027 filed Feb. 4, 1985, now abandoned.

BACKGROUND OF THE INVENTION

The field of this invention relates to dispensing of beverages which are dispensed by combining a quantity of water with a quantity of syrup in correct proportion to be mixed, whipped and then dispensed into a cup or glass.

Within stores and restaurants, such as fast food operations, it is common to have available to the customer a plurality of different types of beverages. Most beverages other than milk are a mixture of a syrup and water. It has been common in the past to have the place of business purchase a quantity of syrup with an employee within the restaurant mixing together, in the desired proportion, a quantity of the syrup with water and then locating such in a beverage dispensing container to be then dispensed to the customers.

This mixing of the beverage requires time by the employee of the restaurant. Also, frequently the proportion is not exactly followed by the employee each time a quantity of the beverage is mixed thereby causing inconsistency.

In order to avoid the problems incurred with mixing of the beverages by an employee, it has been common in the past to use pressurized containers of both syrup and water which are to be supplied to a mixing housing. Mounted on the mixing housing is a control lever which when manually activated will cause both the syrup and the water to be dispensed at the exact correct proportion into a mixing chamber. The contents within the mixing chamber is then dispensed within a cup or glass.

Within recent years, there has been developed a further additional type of beverage wherein the mixed syrup and water is whipped, which saturates the beverage with air bubbles producing a desirable consistency for the beverage. In the past, it has been common to conduct the mixed syrup and water into a separate whipping device prior to being dispensed into the cup or glass. However, this produces a bulky beverage dispenser that takes up additional counter space and limits the number of stores and restaurants willing to install dispensers for whipped beverages.

Accordingly, a need exists for a compact beverage dispenser able to mix and whip a beverage. Preferably, this beverage dispenser should not take up much more room that the beverage dispensers currently used to mix proportionate amounts of syrup and water.

SUMMARY OF THE INVENTION

Briefly an embodiment of the invention is a unitary housing for a beverage dispenser. A whipping chamber is formed within the housing. A conduit is formed within the housing and is adapted to conduct a plurality of different liquids into the whipping chamber and to combine the different liquids at a point prior to reaching the whipping chamber. An air vent passage is formed within the housing for providing a source of air to the whipping chamber. An outlet conduit is formed within the housing for dispensing of the liquids from the whipping chamber out of the housing. Preferably the housing is formed of a rigid block of material.

The present invention incorporates into a single unit a beverage dispenser which includes both the syrup and water mixing section plus a whipping chamber.

The present invention also allows construction of a beverage dispenser which is small in size and can be operated in a most efficient manner by even a most unskilled individual.

Additionally, the present invention allows construction of a beverage dispenser which can be manufactured and sold at a cost less than prior art similar types of beverage dispensers.

One specific embodiment of the present invention utilizes a housing to which is connected at least one conduit for syrup and a separate conduit for water. The syrup conduit is connected to a source of pressurized syrup with the water conduit being connected to a source of pressurized water. Supplying of syrup through the syrup conduit and supplying of water through the water conduit is accomplished through separate solenoids. Mounted on the housing is a pivotable control lever. Pivoting of the control lever in one direction will cause simultaneous dispensing of both the syrup and the water into a mixing chamber located within the housing. The water is dispensed in a turbulent manner so as to facilitate even mixing with the syrup prior to being dispensed into a separate whipping chamber located within the housing.

Located within the whipping chamber is a whipping blade which is motor driven. Activation of the whipping blade is to occur at the time the control rod is moved to activate both the dispensing of the syrup and the water. The then-whipped contents are to be dispensed through an outlet conduit into a cup or glass located exteriorly of the dispenser. The control rod is capable of being moved to a second position which will result in dispensing only the water so as to facilitate cleaning of the beverage dispenser. Additionally, there may be incorporated additional syrup conduits with an operator to be able to select a given syrup conduit to be mixed with the water.

Alternate embodiments of the present invention allow elimination of the separate mixing chamber located within the housing and, instead, rely upon the confluence of the syrup and water conduits at some point upstream of the whipping chamber to provide at least some mixing of the syrup and water before whipping occurs. Additional syrup conduits are also possible with these alternate structures.

DETAILED DESCRIPTION OF THE PREFERRED EMBODIMENTS

Referring particularly to the drawings there is shown the beverage dispenser 10 of this invention which is composed primarily of a housing 12. The housing 12 is formed of a rigid material, with generally a transparent plastic being preferable.

Figure 1:
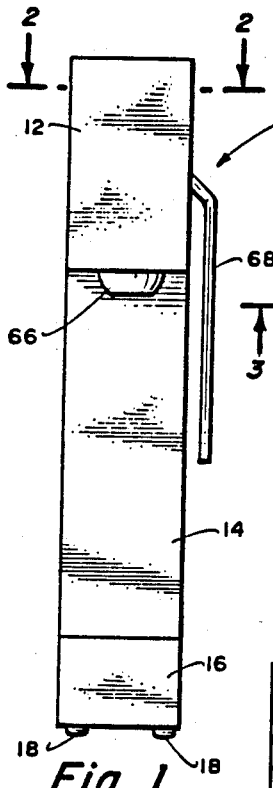
FIG. 1 is a front elevational view of the beverage dispenser of the present invention.

The housing 12 is mounted by appropriate fastening means (not shown) onto a dispensing stand 14 (FIG. 1). The dispensing stand 14 terminates at its lower end thereof into a base 16. Mounted on the bottom surface of the base 16 are a plurality of feet 18. Normally the dispensing stand 14 will rest on a supporting surface such as a table, countertop, bar, etc. The stand 14 will also normally be constructed of sheet metal or other similar type of material. A common form of sheet metal construction would be stainless steel.

Figure 3:
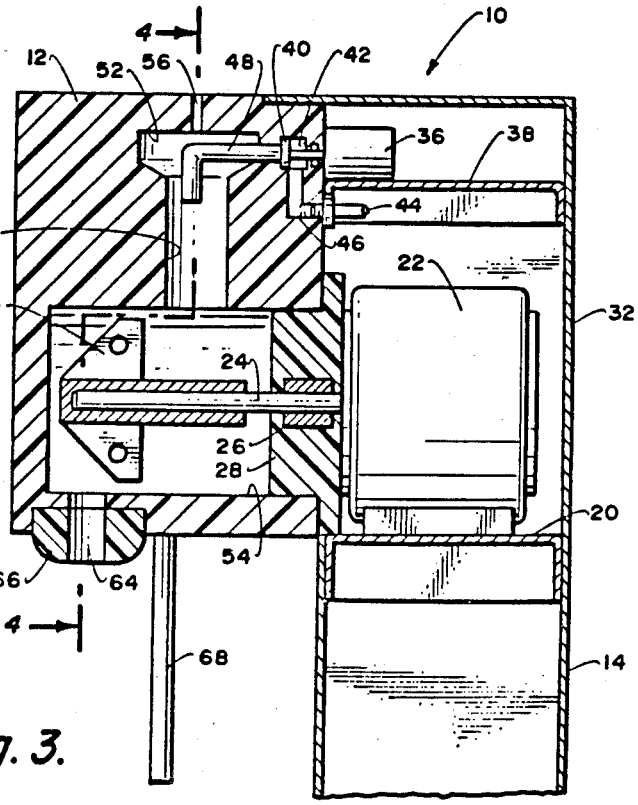
FIG. 3 is a side cross-sectional view of the beverage dispenser of the present invention taken along line 3—3 of FIG. 2.
Figure 4:
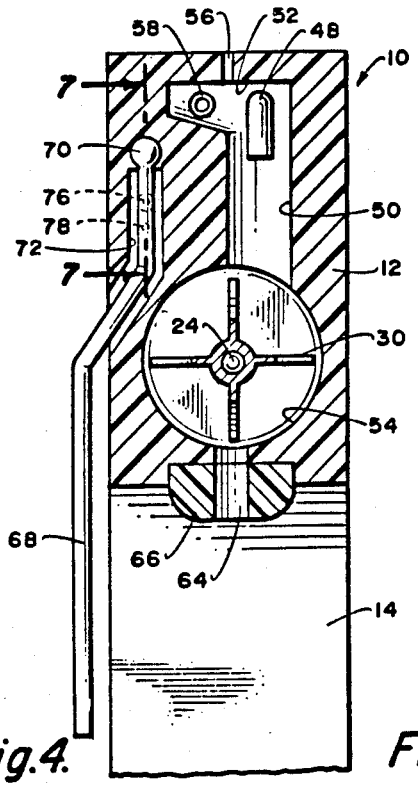
FIG. 4 is a cross-sectional view of the beverage dispenser of the present invention taken along line 4—4 of FIG. 3.

Mounted at the upper end of the stand 14 is a motor mounting base 20 (FIG. 3). Fixedly mounted onto the motor mounting base 20 is an electrical motor 22. The electrical motor 22 is electrically driven from a source of electrical energy (not shown). Motor 22 rotates shaft 24. Shaft 24 is mounted within a bearing 26. The bearing 26 is in turn mounted within a plug 28. Plug 28 is fixedly mounted in position onto the housing 12. The outer end of the shaft 24 is fixedly mounted to a whipping blade 30.

Encasing the motor 22 is a cover 32. The cover 32 will again be constructed of a sheet metal and preferably stainless steel. The upper end of the cover 32 is fixedly mounted onto the upper surface of the housing 12.

Figure 2:
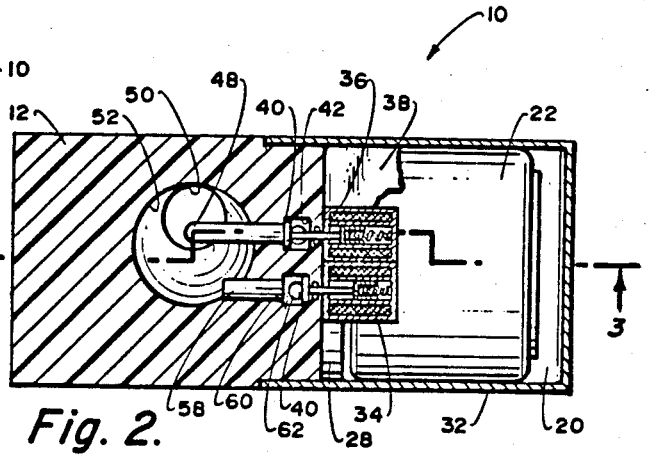
FIG. 2 is a top plan cross-sectional view of the beverage dispenser of the present invention taken along line 2—2 of FIG. 1.
Figure 7:
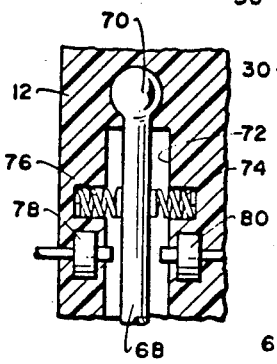
FIG. 7 is a cross-sectional view through the portion of the control rod utilized in conjunction with the beverage dispenser of the present invention taken along line 7—7 of FIG. 4.

Also enclosed by the cover 32 are a pair of solenoids 34 and 36 (FIGS. 2 and 3). Each of the solenoids 34 and 36 are mounted onto the supporting base 38 which in turn is fixedly mounted between the housing 12 and the cover 32. The construction of each of the solenoids 34 and 36 is identical and also conventional. Each solenoid 34 and 36 includes a spring biased valve member 40. When the solenoids 34 and 36 are not electrically activated, the valve members 40 are located in the extended position which is shown in FIG. 3 of the drawings. The valve member 40 (shown in FIG. 3), when in the extended position, closes or seals the chamber 42 (within which it is mounted) and prevents flow of syrup from a source (not shown) through conduit 44, passage 46 formed within the housing 12 and into tube 48. When the solenoid 34 is activated, the valve member 40 is moved to a retracted position permitting flow of the syrup through conduit 44, passage 46 and tube 48. Chamber 42 and the passage 46 are formed within housing 12. The tube 48 is mounted within an appropriate hole formed within housing 12.

The tube 48 is basically elbow shaped. The outer end of the tube 48 is mounted within a connecting conduit 50 which is also formed within the housing 12. Connecting conduit 50 connects between a smaller disc-shaped mixing chamber 52 within an enlarged whipping chamber 54. An air vent passage 56 connects the mixing chamber 52 to the ambient. It has been found that it is desirable to have the air vent passage 56 in order to achieve satisfactory flow of the liquids through the beverage dispenser of this invention. The air vent passage is also desirable to provide a source for the air to be whipped into the beverage in whipping chamber 54.

It is to be noted that the connecting conduit 50 is not centrally mounted (FIG. 2 of the drawings) with respect to the mixing chamber 52. This off-centered mounting is for reasons to facilitate even mixing of the syrup and the water prior to being conducted into the whipping chamber 54.

In order to further insure even mixing of the syrup and water, the tube 58 which dispenses the water into the mixing chamber 52 is mounted within the housing 12 so as to dispense the water substantially tangentially along the annular wall of the mixing chamber 52. This causes the water to "swirl" about the mixing chamber 52 and because of the off-center mounting of the connecting conduit 50 to further "swirl" and function in a turbulent manner as it is passed through the connecting conduit 50. This turbulence helps to evenly mix the syrup which is discharged through the tube 48 directly into the upper end of the connecting passage 50. For purposes of this invention, the upper end of the connecting passage 50 is also considered to be part of the mixing chamber 52.

The tube 58 is similarly mounted within an opening formed within the housing 12 and connects with a chamber 60 (FIG. 2). Mounted within the chamber 60 is the valve seat 40 for the solenoid 34. Water is to be conducted into the passage 62 formed within the housing 12. The water is to be supplied to the passage 62 by an appropriate conduit (not shown) from a pressurized water source (not shown).

The now substantially evenly mixed syrup and water is discharged from the connecting conduit 50 into the chamber 54. This mixture is whipped by means of the blade 30. The resulting mixture assumes a frothed condition (interspersed with air bubbles which are captured within the mixture) and is then discharged through outlet conduit 64 formed within discharge nozzle 66. The mixture, after being conducted through the outlet conduit 64, is to be deposited within a cup or glass (not shown) which is mounted or held directly beneath the outlet conduit 64.

Activation of the solenoids 34 and 36 and the motor 22 is accomplished by moving of rod 68. Rod 68 includes an inner enlarged end 70 which is mounted within an appropriate recess formed within the housing 12. The rod 68 is capable of limited pivoting movement with respect to the housing 12. The portion of the rod 68 which is located directly adjacent the enlarged end 70 is bent and mounted within an elongated recess 72 formed within the housing 12.

The normal at-rest position for the rod 68 is to be centrally disposed within the recess 72 and is held there by the counteracting forces of springs 74 and 76. The springs 74 and 76 are also mounted within the housing 12. Movement of the rod 68 toward the stand 14 results in the rod 68 coming in contact with electrical switch 78. The switch 78 is also mounted within the housing 12. When switch 78 is activated, the solenoid 36 is activated as well as motor 22 and water solenoid 34. This means that both water and syrup are being conducted into the mixing chamber 52 with five or six parts of water being conducted to chamber 52 in relation to one part of syrup. Movement of the rod 68 toward the stand 14 will be automatically accomplished by the operator during locating a cup or glass directly beneath the outlet opening 64. When the desired amount of whipped mixture has been supplied into the cup or glass, the operator merely removes such away from the outlet conduit 64 which means that the rod 68 will again move to its central position and the solenoids 34 and 36 and motor 22 will again be deactivated preventing further flow of syrup and water through the beverage dispenser.

If an individual desires to effect cleaning of the mixing chamber 52, connecting passage 50, blade 30, chamber 54 and outlet conduit 64, the operator only need to move the rod 68 in the opposite direction which causes the rod to come into contact with switch 80. Switch 80 is also mounted within the housing 12. When switch 80 is in this position, only the motor 22 and the water solenoid 34 is activated which results in a flushing of the interior chambers formed within the housing 12. This flushing operation can be continued for as long as desired. Upon release of the rod 68, rod 68 will be again moved by the action of the spring 74 to the centrally-located position and maintained in that position.

Figure 5:
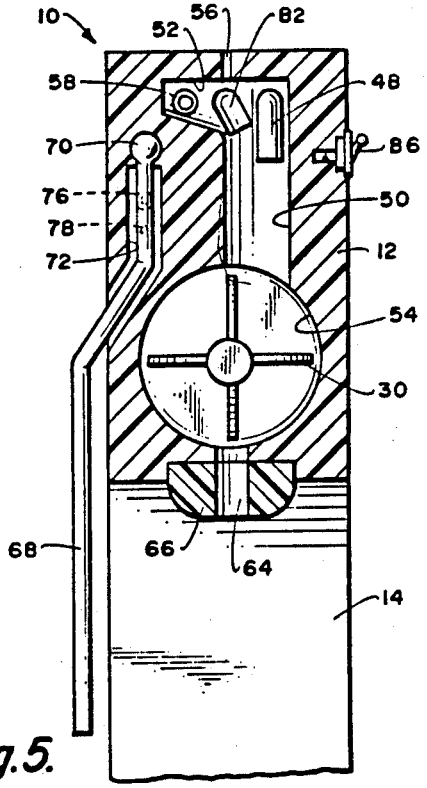
FIG. 5 is a view similar to FIG. 4 but of a modified form of the beverage dispenser of this invention which is designed to dispense two in number of separate syrup lines as opposed to a single syrup line which is shown in FIG. 4.
Figure 6:
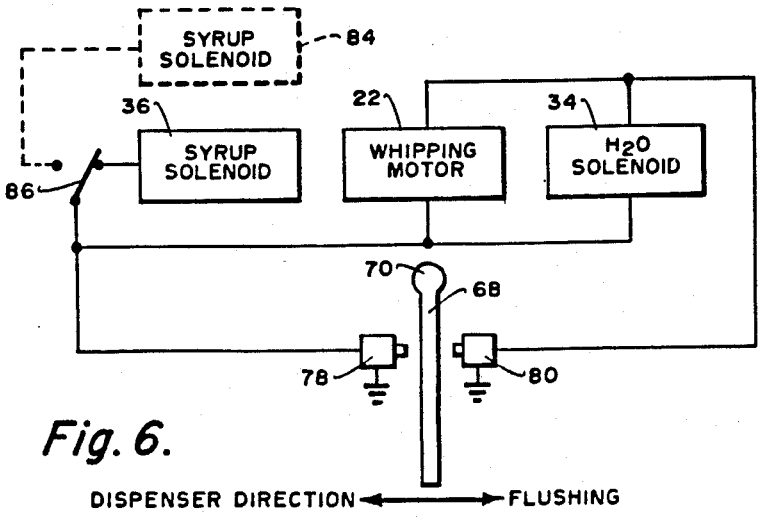
FIG. 6 is an electrical schematic view depicting electrical activation of the solenoids in order to effect the dispensing of the syrup and water to obtain the beverage dispensed by the beverage dispenser of the present invention.

Referring particularly to FIG. 5 of the drawings, it may be desirable to at least make available the supplying of a second syrup line to the mixing chamber 52. The second syrup line would be supplied to a tube 82 which is also in the shape of an elbow. The tube 82 is positioned to discharge the syrup within the connecting conduit 50. The supplying of syrup to the tube 82 is to be controlled by means of a syrup solenoid 84. Either syrup solenoid 84 or syrup solenoid 36 is to be activated, but not both at the same time. An operator is to flip switch 86 to select whether solenoid 84 or solenoid 36 is activated. Typical syrups would be a strawberry syrup to be controlled by solenoid 36 with a cola syrup being controlled by solenoid 84.

It is considered to be also within the scope of this invention that still additional syrups could be supplied within the mixing chamber 52.

Figure 8:
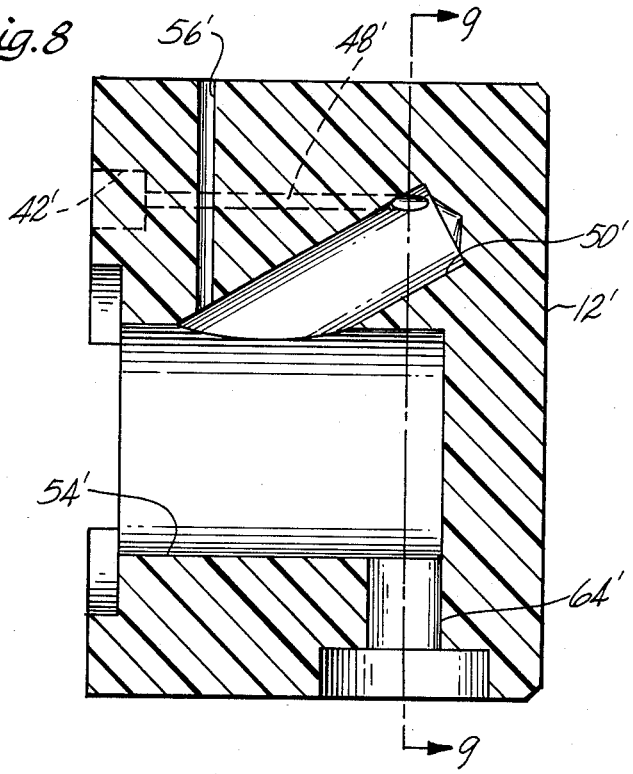
FIG. 8 is a side cross-sectional view of an alternate embodiment of a housing for the beverage dispenser of the present invention.
Figure 9:
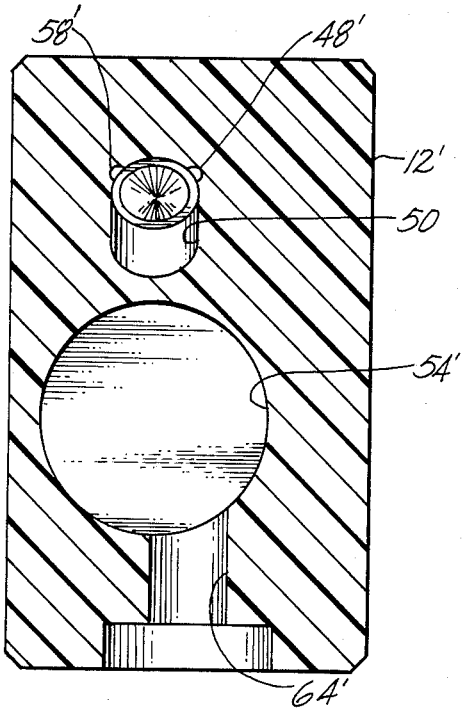
FIG. 9 is a cross-sectional view of the housing of FIG. 8 taken along line 9—9 of FIG. 8.

With reference to FIGS. 8 and 9, an alternate embodiment of housing 12 is depicted. Although this alternate embodiment represents a change in design from the embodiment described previously, many features of the two embodiments function in a similar manner. Therefore, these features have been assigned the same numbers with primes in this embodiment and will not be described in detail in connection with this alternate embodiment except to the extent their functions have changed.

The primary change in the embodiment of FIGS. 8 and 9 over that described previously is the manner in which the syrup and water are combined prior to flowing into the whipping chamber. In the previous embodiment, mixing chamber 52 is designed to provide even mixing of the syrup and water before they enter whipping chamber 54. However, it has been determined that the syrup and water need not be evenly mixed before entering the whipping chamber because the whipping process itself provides a large amount of mixing. Therefore, it is only necessary that the two be combined just prior to entry into the whipping chamber. At least some mixing of the syrup into the water is desirable before entry into the whipping chamber to prevent the syrup from hanging up on the walls of the whipping chamber.

If even mixing of the syrup and water before whipping is not necessary, a separate mixing chamber located within the housing is not necessary. Instead, the confluence of the syrup and water tubes 48′ and 58′ into connecting conduit 50′ at some point upstream of the whipping chamber can be relied upon to provide at least some mixing of the syrup and water before whipping occurs. The person skilled in the art would understand that this can be accomplished in a number of ways. The principal factors involved in designing a system for combining the syrup and water are provision of sufficient mixing of the two before whipping to prevent the syrup from clinging to the walls of the whipping chamber and provision of a design that makes it easy to manufacture the housing.

In the housing of FIGS. 8 and 9, tubes 48′ and 58′ carry the pressurized syrup and water into the top end of cylindrical connecting conduit 50′. Tube 58′ is identical to tube 48′ but is positioned so that it enters connecting conduit 50′ at a point opposite tube 48′. Tubes 48′ and 58′ start at chambers 42′ and 60′ (not shown) located at the edge of the housing. In this embodiment, chambers 42′ and 60′ are adapted to receive a stem (not shown) to which a piece of flexible tubing (not shown) can be connected. The flexible tubing is then connected to a self-contained solenoid (not shown) for controlling the flow of syrup or water.

Conduit 50′, then, extends at an angle back and down to the point where it connects with whipping chamber 54′. The abrupt change in direction the syrup and water must make after entering the connecting conduit creates sufficient turbulence to promote adequate mixing of the syrup and water so that no syrup hangs up on the walls of whipping chamber 54′. Air vent passage 56′ extends down from the top of the housing to connect with the lower end of connecting conduit 50′ just before it connects with the whipping chamber. In this position, the air vent passage can serve to both aid the flow of syrup and water into the whipping chamber and act as a source of air for the whipping process.

This housing 12′ is preferably molded of a transparent plastic. The embodiment of FIGS. 8 and 9 can be molded in a die having inserts to form connecting conduit 50′, whipping chamber 54′ and outlet conduit 64′. The insert forming the connecting conduit is removable and is retracted out of conduit 50′ after molding is completed and before the insert forming the whipping chamber is removed. Alternatively, the connecting conduit can be drilled out after molding of the housing with an insert to form the whipping chamber has been completed. Tubes 48′ and 58′ and air vent passage 56′ can be molded in place or drilled out after molding of the housing has been completed. Thus, the embodiment of FIGS. 8 and 9 presents minimal manufacturing difficulties.

Figure 10:
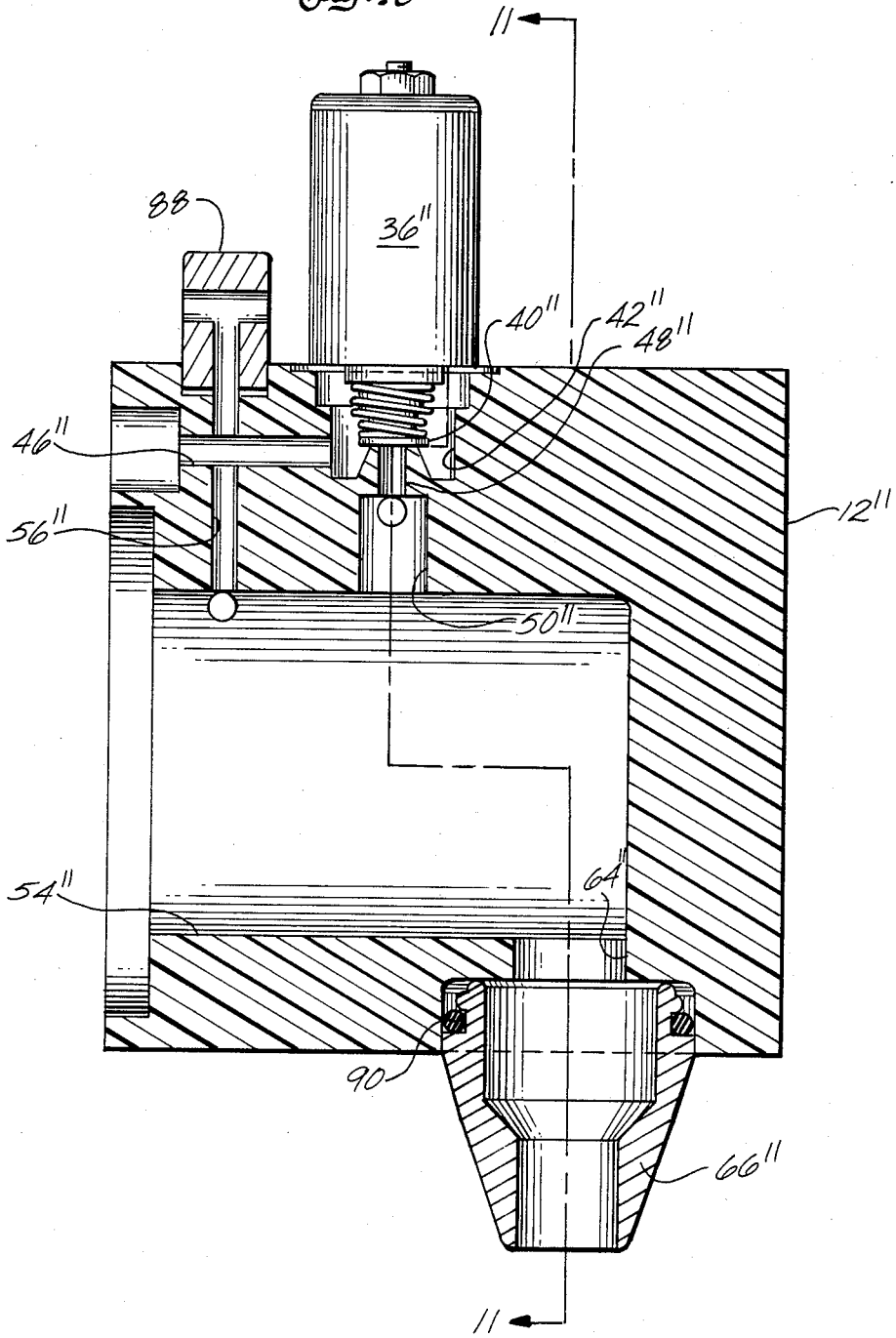
FIG. 10 is a side cross-sectional view of yet another alternate embodiment of a housing for the beverage dispenser of the present invention.
Figure 11:
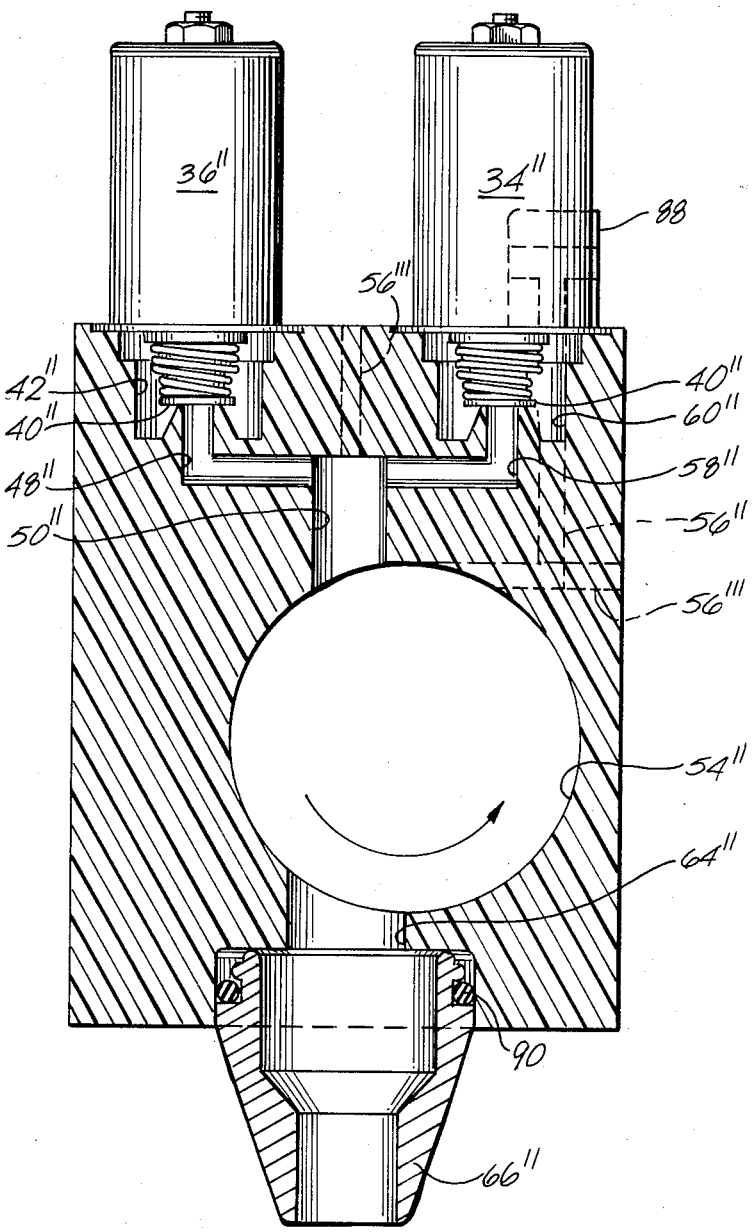
FIG. 11 is a cross-sectional view of the housing of FIG. 10 taken along line 11—11 of FIG. 10.

With reference to FIGS. 10 and 11, yet another alternate embodiment of housing 12 is depicted. This embodiment represents an alternate approach to combining the syrup and water without a separate mixing chamber. As with the embodiment of FIGS. 8 and 9, the features of this embodiment that function in a similar manner to features of this embodiment that function in a similar manner to features of the first embodiment described have been assigned the same numbers with double primes in this embodiment and will not be described in detail in connection with this alternate embodiment except to the extent their functions have changed. It should be noted, that in FIG. 10 some of the passages formed in housing 12" are shown as sectioned for clarity when they would actually be hidden. Reference to FIG. 11 clearly establishes the actual relationship between passages.

In the embodiment of FIGS. 10 and 11, solenoids 34" and 36" for controlling the flow of syrup and water are mounted on the top of the housing. The elimination of the separate mixing chamber allows the solenoids to be mounted on the top of the housing thereby providing a truly unitary housing for the dispenser. Tubes 48" and 58" extend down from chambers 42" and 60", respectively, and then turn at substantially right angles and extend into the top end of connecting conduit 50". Cylindrical conduit 50" extends down to connect with the whipping chamber. Tubes 48" and 58" preferably enter the connecting conduit directly opposite one another. This configuration promotes mixing between the syrup and water because they flow directly at one another in the same plane upon entering the connecting conduit. Therefore, sufficient mixing occurs to prevent the syrup from clinging to the walls of the whipping chamber.

Tubing 48" and 58" need not enter connecting conduit 50" in the same plane. However, it is preferable that these tubes enter the connecting conduit at substantially right angles to the walls of the housing. This is preferred for ease of manufacturing. If the tubes enter connecting conduit 50" at different planes, the tube carrying water should enter above any tube carrying syrup to facilitate mixing and so that the syrup will be washed out of the connecting conduit.

Valve members 40" received in chambers 42" and 60" control the flow of syrup and water from passages 46" and 62" (not shown) into tubes 48" and 58". When solenoids 36" and 34" are activated they retract the valve members and allow the syrup and water to flow down into tubes 48" and 58".

Air vent passage 56" preferably extends down from the top of the housing, turns at substantially a right angle and connects tangentially with the whipping chamber. In this position, the air vent passage acts as a source of air for the whipping process and still aids the flow of syrup and water into the whipping chamber. The top opening of the air vent passage is preferably fitted with an air inlet filter 88. Filter 88 is a plug that extends the air vent passage up above the top surface of the housing and has openings parallel to the top surface of the housing. The filter prevents materials spilled on the top of the housing from dropping down the air vent passage to contaminate the beverage being whipped and dispensed. Alternatively, the air vent passage can open to the side of the housing, as shown in phantom in FIG. 11 as 56"', so that it is more difficult for materials to spill down the air vent passage.

Another type of common discharge nozzle is shown in FIGS. 10 and 11. This type of discharge nozzle has a narrowing throat that provides some hold up time for the beverage in the whipping chamber. An "O"-ring 90 around the neck of the discharge nozzle prevents leakage between the nozzle and the housing.

Again, the housing is preferably molded of transparent plastic. Connecting conduit 50" could possibly be formed using a removable insert that is retracted prior to retraction of the mold insert for whipping chamber 54". However, it would be difficult to remove this insert after molding was completed. Alternatively, the conduit can be created by drilling down from the top of the housing and then plugging the top end of the hole created. The horizontal segments of tubes 48" and 58" and air vent passage 56" are also created by drilling and plugging. If the air vent passage is to open to the side, no vertical hole would have to be drilled for it and the horizontal hole would not have to be plugged. This would also allow the air vent passage to be formed during molding if desired. The air vent passage could also be located so that it extends down from the top of the housing to the top of connecting conduit 50" so as to take advantage of the fact that the conduit is to be created by drilling and plugging. In this case, the top end of the hole created in drilling out the conduit would be plugged with a piece having an air vent passage therein. This location for such an air vent passage is also shown in phantom in FIG. 11 as 56"'.

The two alternate housing embodiments can also be adapted to handle additional syrup lines. It is only necessary to provide the tubes in the housing necessary to place additional syrup lines in communication with the top end of the connecting conduit. The manner in which these tubes deliver the additional syrups to the connecting conduit should still create sufficient turbulence and mixing to avoid syrup hanging up on the walls of the whipping chamber. With the embodiment of FIGS. 8 and 9, this means creating an abrupt change in the direction of flow with the water line and as abrupt a change in the direction of flow as is possible to accomplish with the given orientation of the connecting conduit with the additional syrup lines. The abrupt change in the direction of flow of the water will create the turbulence needed for adequate mixing. With the embodiments of FIGS. 10 and 11, this means positioning the tubes for the additional syrup lines so that the syrup streams will be directed toward the water stream in the same plane of flow.

According to the present invention, a compact beverage dispenser has been described that is able to provide adequate mixing of syrup and water and then whipping of the syrup and water combination in a unitary housing. The mixing of syrup and water prior to whipping is sufficient to prevent syrup from hanging up on the walls of the whipping chamber and to result in an evently mixed and whipped beverage upon exit from the whipping chamber.

What is claimed is:

1. A beverage dispenser comprising:

a housing formed of a rigid block of material, said housing being transparent;

a mixing chamber formed within said housing, conduit means connecting with said mixing chamber, said conduit means being adapted to conduct a plurality of different liquids to be then dispensed within said mixing chamber;

an air vent passage formed within said housing, said air vent passage connecting with said mixing chamber;

control means connected to said conduit means, said control means for causing conducting of the liquids into said mixing chamber;

a whipping chamber formed within said housing a connecting conduit connecting said mixing chamber with said whipping chamber, whipping means mounted on said housing and extending within said whipping chamber, said whipping means being activatable for whipping of the liquids that have been conducted from said connecting conduit into said whipping chamber; and an outlet conduit mounted on said housing, said outlet conduit for dispensing of the whipped liquids from said whipping chamber into the ambient.

2. The beverage dispenser as defined in claim 1 wherein:

the plurality of different liquids comprise at least a water and a syrup, said mixing chamber defining an outer wall, said connecting conduit connecting with said mixing chamber, said water being dispensed into said mixing chamber substantially tangential to said outer wall.

3. The beverage dispenser as defined in claim 1 wherein:

activation of said control means results in substantially simultaneous activation of said whipping means.

4. A beverage dispenser comprising:

a housing;

a mixing chamber formed within said housing, conduit means connecting with said mixing chamber, said conduit means being adapted to conduct a plurality of different liquids to be then dispensed within said mixing chamber;

control means connected to said conduit means, said control means for causing conducting of the liquids into said mixing chamber;

a whipping chamber formed within said housing, a connecting conduit connecting said mixing chamber with said whipping chamber, whipping means mounted on said housing and extending within said whipping chamber, said whipping means being activatable for whipping of the liquids that have been conducted from said connecting conduit into said whipping chamber; and the plurality of different liquids comprise at least one syrup and water, said control means comprising a manually movable rod, said rod being pivotly mounted on said housing, said rod being movable in either a first direction or a second direction with said second direction being opposite to said first direction, movement of said rod in said first direction results in dispensing of said water and said one syrup simultaneously, movement of said rod in said opposite direction results in dispensing of only said water.

5. The beverage dispenser as defined in claim 4 wherein:

there being two in number of said syrups, switch means mounted on said housing for manually selecting which said syrup is to be dispensed at the time said rod is moved in said first direction.

6. A beverage dispenser comprising:

a housing formed of a rigid block of material;

a whipping chamber formed within said housing;

conduit means adapted to conduct a plurality of different liquids into said whipping chamber and to combine the different liquids with at least sufficient mixing to prevent any one of the liquids from hanging up on the walls of said whipping chamber at a point within said housing prior to reaching said whipping chamber;

whipping means mounted within said whipping chamber for whipping of the liquids that have been conducted into said whipping chamber;

means for providing a source of air to said whipping chamber; and means for dispensing of the whipped liquids from said whipping chamber out of said housing.

7. A beverage dispenser according to claim 6 wherein the housing is transparent.

8. A beverage dispenser according to claim 6 wherein the means for providing a source of air to said whipping chamber is an air vent passage formed within said housing.

9. A beverage dispenser according to claim 6 wherein at the point within said housing where the different liquids are combined the conduit means creates an abrupt change in the direction of flow of the liquids.

10. A beverage dispenser according to claim 6 wherein at the point within said housing where the different liquids are combined the conduit means directs the different liquid streams toward one another in the same plane of flow.

11. A beverage dispenser according to claim 6 wherein the combination of the different liquids achieves even mixing of those liquids.

12. A beverage dispenser according to claim 6 wherein the combination of the different liquids achieves sufficient mixing of those liquids to produce an even mixture of the liquids upon dispensing of the whipped liquids from said whipping chamber into the ambient.

13. A beverage dispenser according to claim 6 also including means for preventing contaminants from entering through the means for providing a source of air.

14. A unitary housing for a beverage dispenser comprising:

a whipping chamber formed within said housing;

conduit means formed within said housing adapted to conduct a plurality of different liquids into said whipping chamber and to combine the different liquids with at least sufficient mixing of those liquids to prevent any one of the liquids from hanging up on the walls of said whipping chamber at a point prior to reaching said whipping chamber;

an air vent passage formed within said housing for providing a source of air to said whipping chamber; and an outlet conduit formed within said housing for dispensing of the liquids from said whipping chamber out of said housing.

15. A unitary housing according to claim 14 wherein the housing is formed of a rigid block of material.

16. A unitary housing according to claim 14 wherein the housing is transparent.

17. A unitary housing according to claim 14 wherein the conduit means includes a mixing chamber formed within the housing and adapted to provide even mixing of different liquids conducted through the conduit means before the liquids enter said whipping chamber.

18. A unitary housing according to claim 14 wherein the conduit means undergoes an abrupt change in direction at the point where different liquids conducted through the conduit means are combined.

19. A unitary housing according to claim 14 wherein the conduit means directs the different liquid streams toward one another in the same plane of flow at the point where liquids conducted through the conduit means are combined.

20. A unitary housing according to claim 14 also including an air inlet filter for preventing contaminants from entering through the air vent passage.

21. A method for mixing, whipping and dispensing beverages comprising the steps of:

conducting a plurality of different liquids to a whipping chamber in a unitary block of material;

combining the plurality of different liquids in the same unitary block of material so as to provide at least some mixing of the liquids before they are conducted to the whipping chamber;

providing a source of air to the whipping chamber;

whipping, in the same unitary block of material, the liquids that have been conducted into said whipping chamber so as to produce a substantially even mixture of the liquids; and dispensing the whipped and substantially evenly mixed liquids out of said unitary block of material.

22. A method for mixing, whipping and dispensing beverages according to claim 21 wherein the combining of the different liquids achieves just enough mixing of those liquids to prevent any one of the liquids from hanging up on the walls of the whipping chamber.

* * * * *